US006223860B1

(12) United States Patent
Namba et al.

(10) Patent No.: US 6,223,860 B1
(45) Date of Patent: May 1, 2001

(54) CONTROL DEVICE FOR ELEVATOR

(75) Inventors: Yasuhiro Namba; Tatsushi Takahashi; Shigeki Yamakawa; Takehiko Kubota, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/402,545

(22) PCT Filed: Jun. 16, 1998

(86) PCT No.: PCT/JP98/02644

§ 371 Date: Oct. 6, 1999

§ 102(e) Date: Oct. 6, 1999

(87) PCT Pub. No.: WO99/65811

PCT Pub. Date: Dec. 23, 1999

(51) Int. Cl.[7] ..... B66B 1/00
(52) U.S. Cl. ..... 187/277; 127/391
(58) Field of Search ..... 187/277, 391, 187/314, 333, 413, 414

(56) References Cited

U.S. PATENT DOCUMENTS

| | | | | |
|---|---|---|---|---|
| 5,379,863 | * | 1/1995 | Sugawara et al. | 187/233 |
| 5,429,211 | * | 7/1995 | Aulanko et al. | 187/254 |
| 5,450,929 | * | 9/1995 | Ohgita et al. | 187/244 |
| 5,773,771 | * | 6/1998 | Chatham | 187/282 |
| 6,006,866 | * | 12/1999 | Horne et al. | 187/316 |

FOREIGN PATENT DOCUMENTS

| | | | | |
|---|---|---|---|---|
| 894297 | * | 4/1962 | (EP) | 187/391 |
| 0048847 | | 4/1982 | (EP) . | |
| 0631968 | | 1/1995 | (EP) . | |
| 57-121568 | | 7/1983 | (JP) . | |
| 63-180669 | | 11/1988 | (JP) . | |
| 401252475 | * | 10/1989 | (JP) | 187/391 |
| 402295869 | * | 12/1990 | (JP) | 187/391 |
| 402310273 | * | 12/1990 | (JP) | 187/391 |
| 403003878 | * | 1/1991 | (JP) | 187/391 |
| 403003885 | * | 1/1991 | (JP) | 187/391 |
| 403098970 | * | 4/1991 | (JP) | 187/391 |
| 4235873 | | 8/1992 | (JP) . | |
| 680359 | | 3/1994 | (JP) . | |
| 7-10437 | | 1/1995 | (JP) . | |
| 710434 | | 1/1995 | (JP) . | |

* cited by examiner

*Primary Examiner*—Jonathan Salata
(74) *Attorney, Agent, or Firm*—Leydig, Voit & Mayer, Ltd.

(57) ABSTRACT

In an elevator controlling apparatus, a first suspension member and a second suspension member are fixed to a guide rail at a vertical interval. A control panel can be suspended from either a first or second suspension member. Thus, the control panel can be moved between a operation position at a first height from a bottom portion of a hoistway and a maintenance position lower than a operation position. A junction box is fixed on a hoistway wall. The junction box and the control panel are connected to each other through flexible cables.

13 Claims, 7 Drawing Sheets

CONTROL DEVICE FOR ELEVATOR

TECHNICAL FIELD

The present invention relates to a controlling apparatus for an elevator, disposed within a hoistway for controlling the operation of an elevator.

BACKGROUND ART

In a conventional elevator apparatus, since the drive machine, control panel and the like are installed in a machine room provided on an upper portion of a hoistway, it is necessary to provide a space for the machine room at an uppermost portion of a building. The utility efficiency of the building is consequently degraded and the height of the building is increased. In contrast, for example, there is proposed an elevator apparatus in which the drive machine is disposed in a hoistway to thereby dispense with a machine room. Concomitant with this, the control panel also has to be installed within the hoistway.

For example, Japanese Patent Application Laid-Open No. 7-10437 and Japanese Patent Application Laid-Open No. 10-114481 discloses an elevator apparatus in which a control panel is disposed within a hoistway. However, in these apparatuses, since the control panel is fixed to the bottom of the hoistway, if water or the like enters the hoistway and accumulates in the bottom portion, if is possible that the control panel could be damaged and cease to function properly as a result of being lowered into the water.

On the other hand, in the elevator apparatus disclosed in Japanese Utility Model Application Laid-Open No. 63-180669, the control panel is moveably supported to a mounting bracket through rails and guide members. However, in this apparatus, the control panel is disposed in a machine room above the hoistway, and in addition, the control panel is only movable in a horizontal direction. Consequently, even if such a support structure was to be applied to the bottom portion of the hoistway, it would be impossible to avoid immersing the control panel in any water that had accumulated.

DISCLOSURE OF THE INVENTION

In view of the above-noted defect, an object of the present invention is to provide an elevator controlling apparatus in which a control panel is disposed within a hoistway to make it possible to decrease the height of a building and to prevent water from entering the control panel.

According to the present invention, there is provided an elevator controlling apparatus comprising: a support mechanism provided within a hoistway; and a control panel for controlling the operation of an elevator, said control panel being supported in a normal position at a predetermined height from a bottom portion of the hoistway by the support mechanism and movable vertically between the normal position and a maintenance position lower than the normal position.

BEST MODE FOR CARRYING OUT THE INVENTION

A preferable embodiment of the present invention will now be described with reference to the accompanying drawings.

First Embodiment

Figure 1:
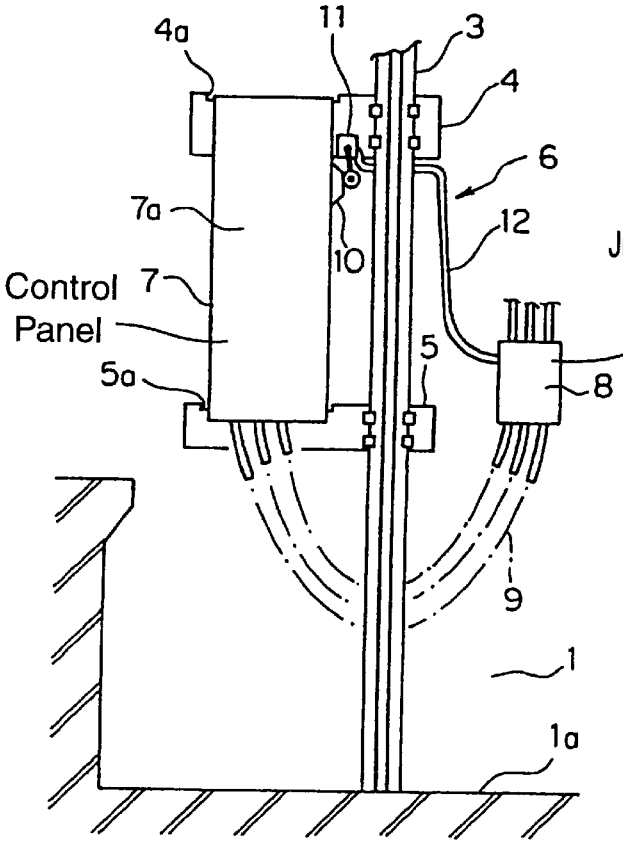
FIG. 1 is a front view showing an elevator controlling apparatus in accordance with a first embodiment of the present invention.
Figure 2:
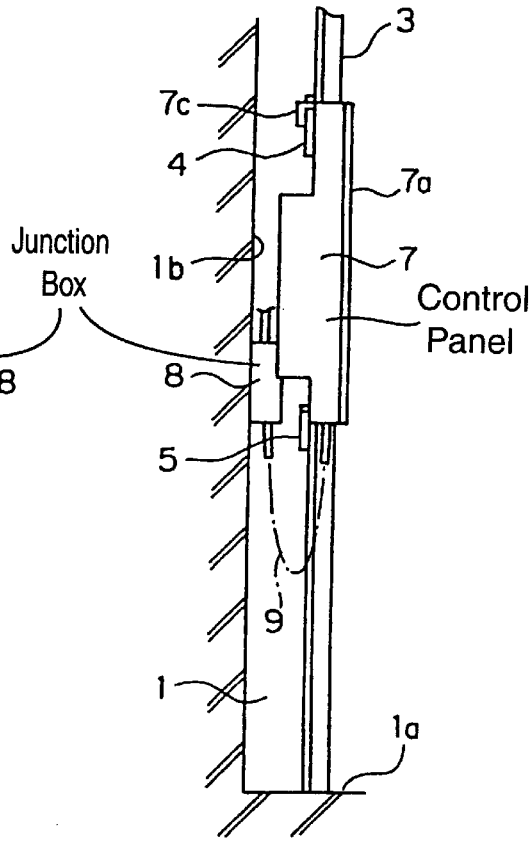
FIG. 2 is a side elevational view showing the apparatus shown in FIG. 1.
Figure 3:
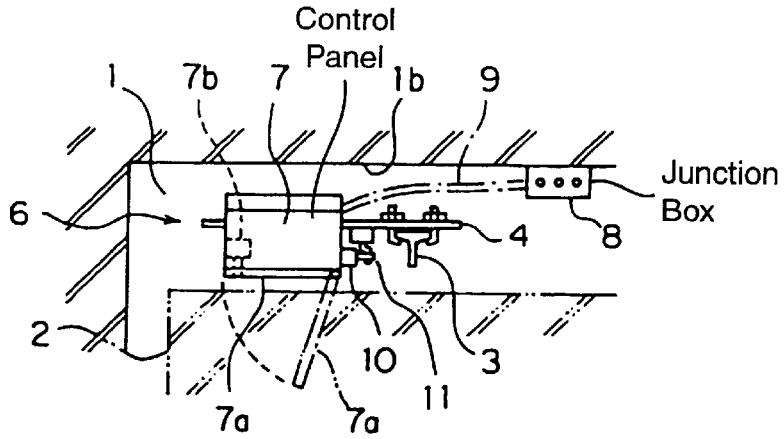
FIG. 3 is a plan view showing the apparatus shown in FIG. 1.
Figure 4:
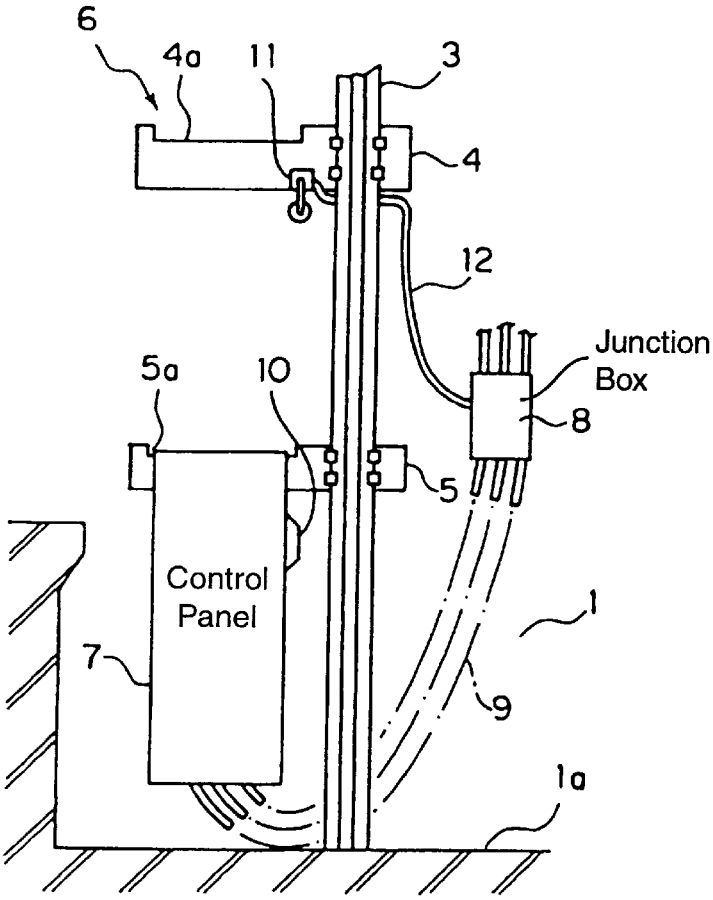
FIG. 4 is a front view showing the apparatus shown in FIG. 1 during maintenance operations.

FIG. 1 is a front view showing an elevator controlling apparatus in accordance with a first embodiment of the present invention, FIG. 2 is a side elevational view showing the apparatus shown in FIG. 1; FIG. 3 is a plan view showing the apparatus shown in FIG. 1; and FIG. 4 is a front view showing the apparatus shown in FIG. 1 during maintenance operations.

In the drawings, a guide rail 3 for guiding the ascent/descent of a car 2 which is an ascending/descending body is installed within a hoistway 1. A first suspension member 4 extending horizontally is fixed to the guide rail 3. Also, a second suspension member 5 extending in the horizontal direction is fixed below the first suspension member 4 of the guide rail 3. A support mechanism 6 is composed of the first and second suspension members 4 and 5. Recessed portions 4*a* and 5*a* are formed on top surfaces of the first and second suspension members 4 and 5 respectively.

A control panel 7 for controlling the operation of the elevator is suspended selectively from one of the first and second suspension members 4 and 5. In other words, the control panel 7 may readily be moved between a normal position (in FIG. 1) at a predetermined height from a bottom portion 1*a* of the hoistway 1 and a maintenance position (FIG. 4) lower than the normal position. Also, the control panel has a door 7*a* which is provided on a front surface thereof so as to be capable of opening and closing, a door detection switch 7*b* for detecting whether the door 7*a* is closed, and a hook 7*c* to be hooked on a recessed portion 4*a* or 5*a*.

A junction box 8 for connecting the transmission of a signal or electric power between each instrument of the elevator and the control panel 7 is fixed to the hoistway wall 1*b*. The junction box 8 and the control panel 7 are electrically connected to each other through a plurality of flexible cables 9. The cables 9 are suspended between the junction box 8 and the control panel 7 so that their intermediate portions may be in a U-shape and have sufficient length to allow the movement of the control panel 7.

A switch operating cam 10 is fixed to a side wall of the control panel 7. A position detecting switch 11 operated by the switch operating cam 10 for detecting whether the control panel 7 is located in the normal portion is mounted on the first suspension member 4. The position detecting switch 11 is electrically connected to the control panel 7 through a signal cable 12 and the junction box 8.

Figure 5:
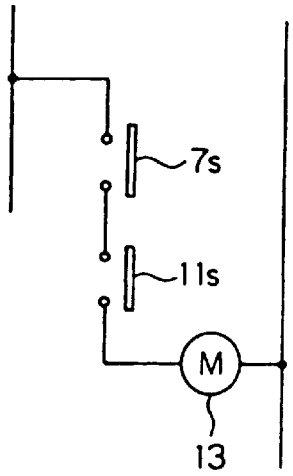
FIG. 5 is a circuit diagram showing a maintenance mode selection relay circuit of the controlling apparatus shown in FIG. 1.

FIG. 5 is a circuit diagram showing a maintenance mode selection relay circuit of the controlling apparatus shown in FIG. 1. A contact 7*s* of the door detection switch 7*b* to be closed when the door 7*b* is closed and a contact 11*s* of the position detecting switch 11 to be closed when the control panel 7 is located in the normal position are connected in series with each other to a relay 13 for switching the operation mode of the elevator to the maintenance mode. Then, when the relay 13 is not magnetically excited, the operation mode of the elevator is switched to the maintenance mode. In the maintenance mode, the lowermost descending position of the car 2 is restricted, and at the same time, the ascending/descending speed of the car 2 is switched to a so-called manual speed which is lower than a rated speed.

In such an elevator, since the control panel 7 is disposed within the hoistway 1, the machine room may be dispensed with and the height of the building may be reduced. Also, since the control panel 7 is normally supported in the normal position; at a predetermined height from the bottom portion 1*a* of the hoistway 1, the control panel 7 is prevented from being immersed in any water that may accumulate in the bottom portion 1*a* of the hoistway 1, thereby enhancing reliability. Furthermore, since the control panel 7 may readily be moved to the maintenance position in the maintenance mode, maintenance operations are never obstructed.

Moreover, since the control panel 7 and the junction box 8 are connected to each other through the flexible cables 9, the transmission of electric power and signals will not be interrupted, even if the control panel 7 is moved. Also, since the junction box 8 is installed within the hoistway 1, the length of the flexible cables 9 may be kept to a minimum, and the junction box 8 and other elevator instruments may be connected to each other through less expensive connecting wire.

Also, since the door detection switch 7*b* for detecting the opening/closing of the door 7*a* is provided on the control panel 7, and the mode of operation is switched to the maintenance mode when the door 7*a* is opened, the car 2 is prevented from colliding with the door 7*a*. Furthermore, since the position detecting switch 11 is mounted on the first suspension member 4 and the operation mode is switched to the maintenance mode when the control panel 7 is moved from the normal position, it is possible to automatically restrict the lowermost descending position of the car 2 during maintenance operations.

Moreover, since the support mechanism 6 is fixed to the guide rail 3, which is one of the more rigid structural members within the hoistway 1 and which is installed with high precision, the control panel 7 may be securely installed with high precision.

Further, in the first embodiment, the first and second suspension members 4 and 5 are fixed to the guide rail 3. However, it is possible, for instance, to attach the first and second suspension members 4 and 5 to a support post fixed in the bottom section 1*a* as separate from the guide rail 3.

Second Embodiment

Figure 6:
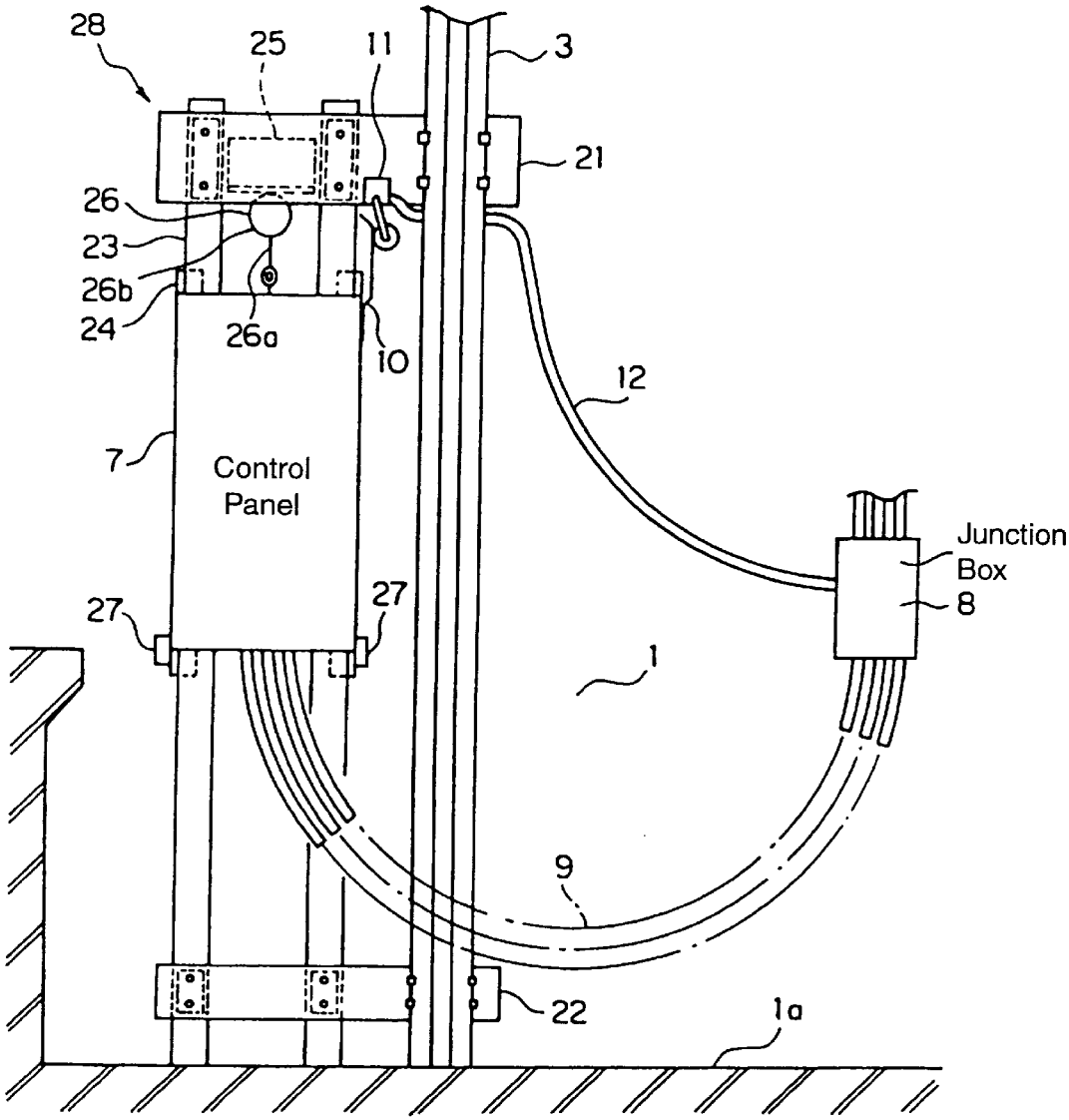
FIG. 6 is a front view showing an elevator controlling apparatus in accordance with a second embodiment of the present invention.
Figure 7:
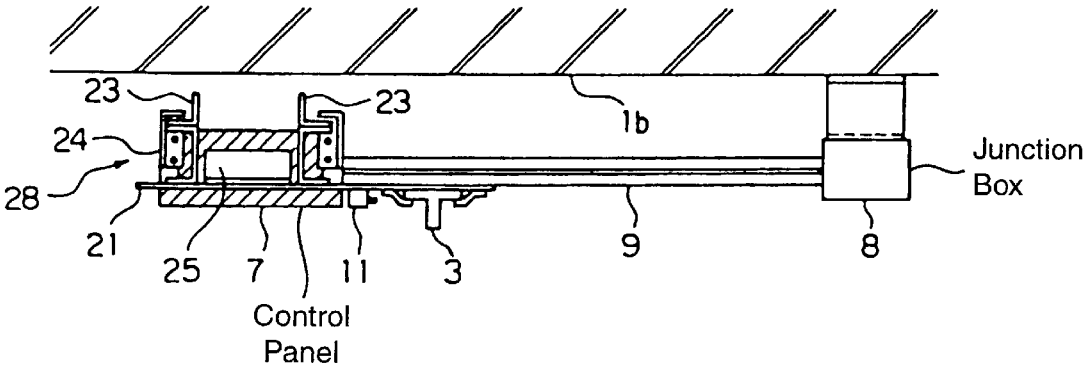
FIG. 7 a plan view of the apparatus shown in FIG. 6.

Next, FIG. 6 is a front view showing an elevator controlling apparatus in accordance with a second embodiment of the present invention, and FIG. 7 is a plan view of the apparatus shown in FIG. 6. In the drawings, a support member 21 extending in a horizontal direction is fixed to a guide rail 3. A fixing member 22 extending in the horizontal direction is fixed below the support member 21 of the guide rail 3.

A pair of control panel rails 23 extending in parallel with the guide rail 3 are fixed to the support member 21 and the fixing member 22. The lower end portions of the control panel rails 23 are in contact with a bottom portion 1*a* of a hoistway 1. A plurality of guide members 24 which are engaged with the control panel rails 23 are mounted on a control panel 7. With such an arrangement, the control panel 7 may be moved up and down along the control panel rails 23.

A lifting device 26 is mounted on the support member 21 through a mounting member 25 having an L-shaped cross-section. Normally, the control panel 7 is lifted to the normal position shown in FIG. 6 by the lifting device 26. The lifting device 26 has, for example, a wire rope 26*a* for suspending the control panel 7 and a winding portion (bobbin) 26*b* for winding the wire rope 26*a* against the gravitational force acting on the control panel 7. For example, a spiral spring (not shown) is provided in the winding portion 26*b*. The winding portion 26*b* has, for example, a structure like hangers for suspending electric power tools in factories.

A maintenance position holding mechanism 27 retained by the fixing member 22 for holding the control panel 7 in the maintenance position lower than the normal position is provided on the control panel 7. A support mechanism 28 according to this second embodiment is composed of the support member 21, the mounting member 25 and the lifting device 26. Apart from this, the structure is the same as that of the first embodiment.

In such a controlling apparatus, it is possible to prevent the control panel 7 from being immersed in water in the normal condition and to enhance the maintenance workability by lowering the control panel 7 down to the maintenance position in the maintenance mode. Also, since the control panel 7 can be raised/lowered between the normal position and the maintenance position along the control panel rail 23, it is possible to prevent swinging and rotation of the control panel 7 during movement to thereby allow smooth movement of the control panel 7.

Also, since an upward force from the lifting device 26 is always applied to the control panel 7, irrespective of the weight of the control panel 7, it is possible to readily raise/lower the control panel 7 and to enhance workability. In particular, since the lifting force from the lifting device 26 is set to be greater than the gravitational force acting on the control panel 7, it is possible to readily return the heavy control panel 7 from the maintenance position to the normal position.

Furthermore, since the maintenance position holding mechanism 27 is provided on the control panel 7, it is possible to readily hold the control panel 7 at the maintenance position during maintenance operations to thereby enhance workability.

In addition, the lifting force applied by the lifting device 26 may be set to be smaller than the gravitational force acting on the control panel 7. However, in this case, a holding mechanism for holding the control panel 7 in the normal position in the normal mode is required.

Also, the lifting device is not limited to a type for winding a wire rope. It is also possible to use a pantograph-type lifting device in which, for example, the support member and the control panel are connected to each other by an extendable link mechanism having a pantograph shape and a spring force is applied in a direction in which the link mechanism is retracted.

Furthermore, it is possible to dispense with the control panel rail. For example, in cases where a pantograph-type lifting device is used, since the lifting device also serves as a guide mechanism, it is possible to dispense with the control panel rail.

Furthermore, it is possible to attach a drive device such as a motor or the like to the support member 21 and thereby raise on lower the control panel 7 along the control panel rail 23 utilizing the drive force of the drive device.

Third Embodiment

Figure 8:
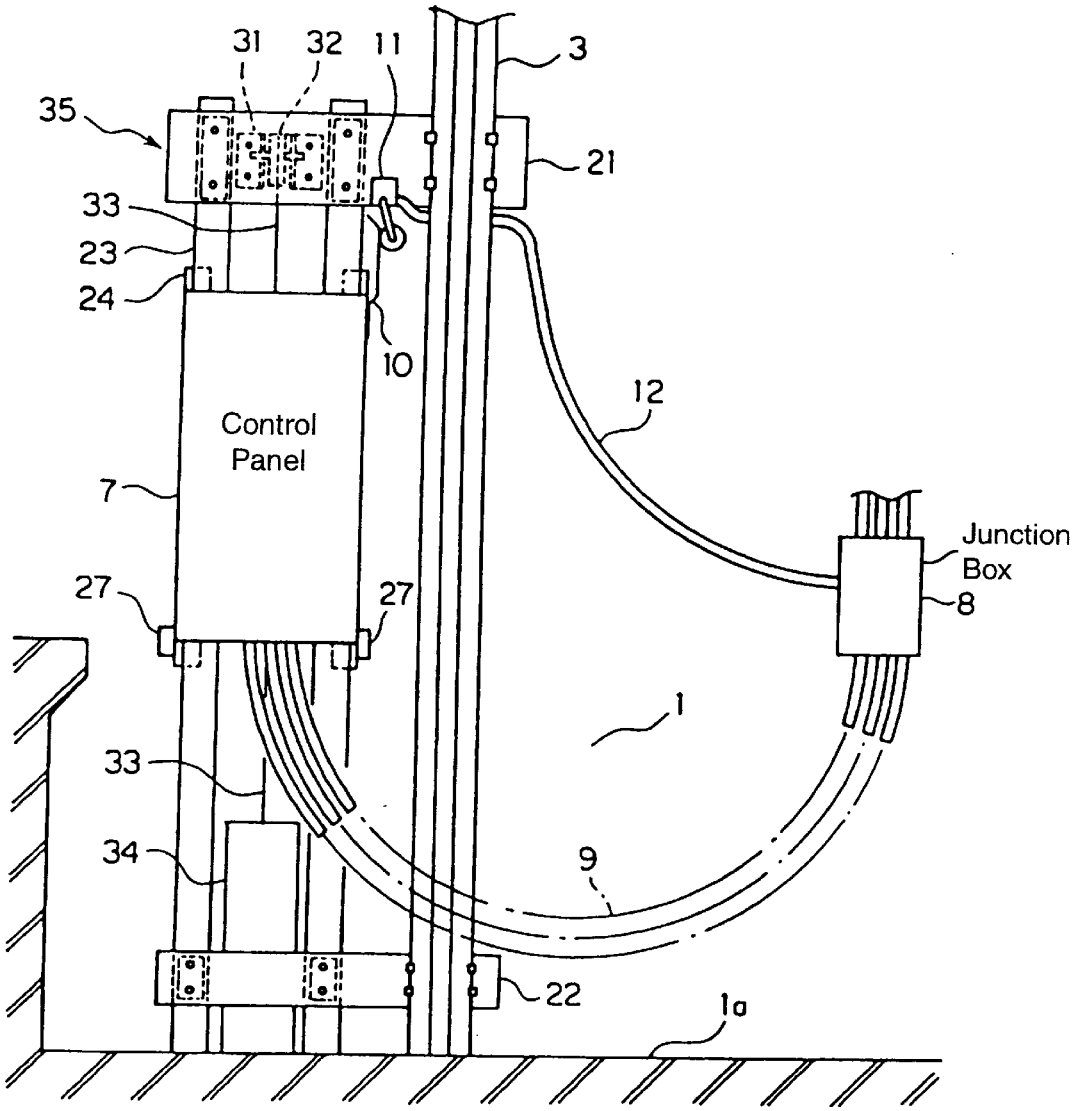
FIG. 8 is a front view showing an elevator controlling apparatus in accordance with a third embodiment of the present invention.
Figure 9:
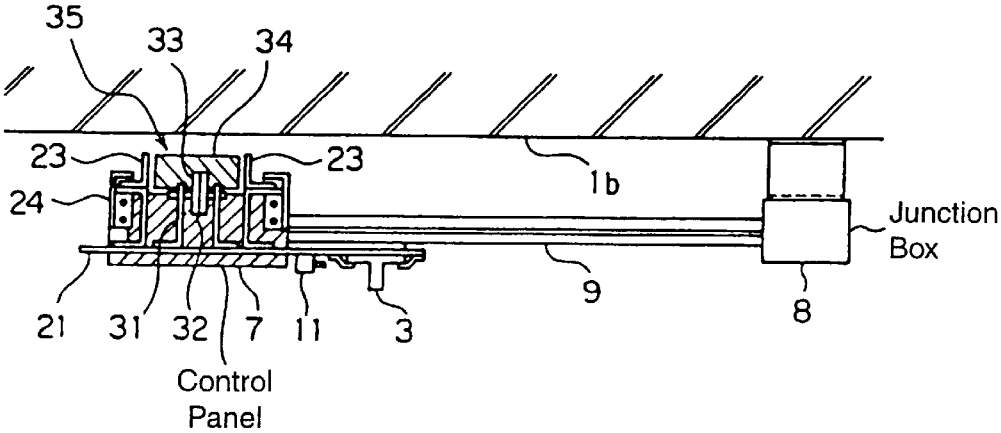
FIG. 9 is a plan view of the apparatus shown in FIG. 8.
Figure 10:
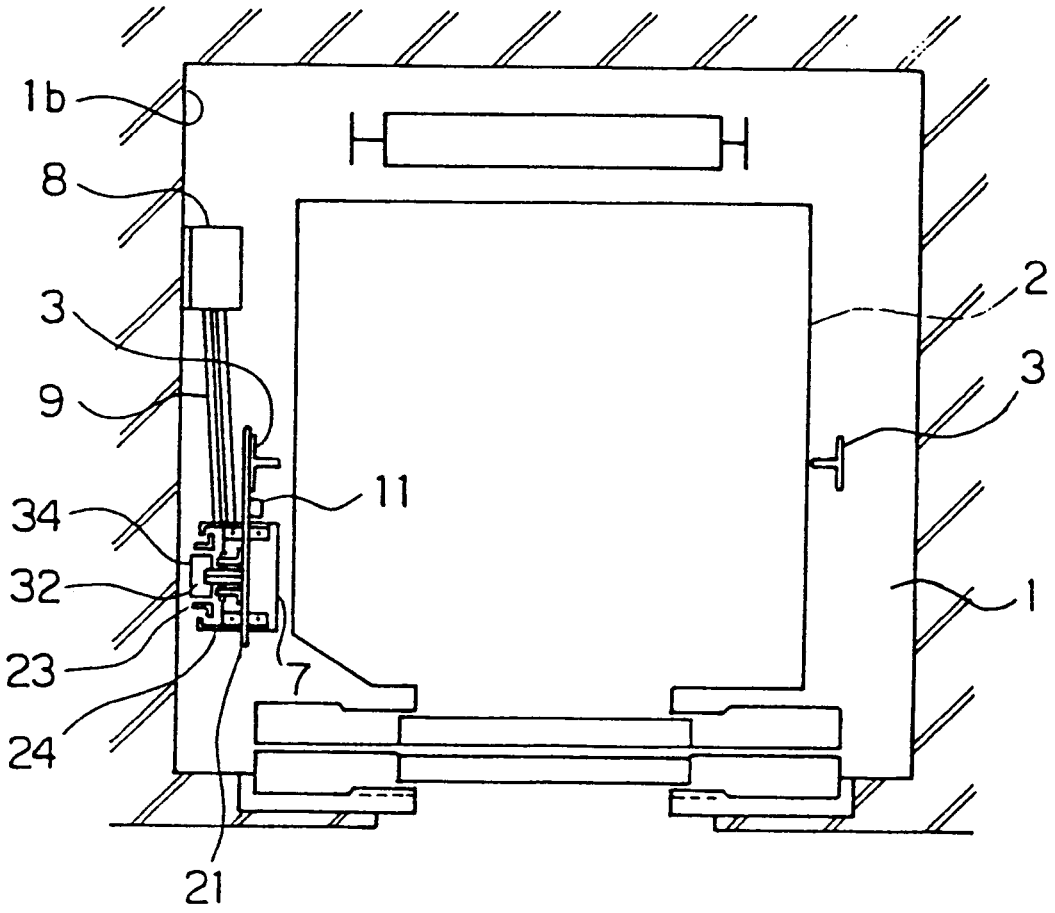
FIG. 10 is a horizontal sectional view of a hoistway in which the apparatus shown in FIG. 8 is installed.

Next, FIG. 8 is a front view showing an elevator controlling apparatus in accordance with a third embodiment of the present invention, FIG. 9 is a plan view of the apparatus shown in FIG. 8, and FIG. 10 is a horizontal sectional view of a hoistway in which the apparatus shown in FIG. 8 is installed. In the drawings, a rotatable pulley 32 is mounted through a mounting member 31 to a support member 21. A control panel suspension rope 33 is wound around the pulley 32. The control panel 7 is suspended at one end portion of the control panel suspension rope 33. A control panel counter-weight 34 that is heavier than the control panel 7 is suspended at the other end portion of the control panel suspension rope 33.

A support mechanism 35 according to the third embodiment 3 is composed of the support member 21, the mounting member 31, the pulley 32, the control panel suspension rope 33 and the control panel counter-weight 34. The other structure is the same as that of the second embodiment.

In such a controlling apparatus, it is possible to prevent the control panel 7 from being immersed in any water during normal operation and to enhance the maintenance workability by lowering the control panel 7 down to the maintenance position in the maintenance mode. Also, since an upward force from the control panel counter-weight 34 is always applied to the control panel 7, irrespective of the weight of the control panel 7, it is possible to readily raise/lower the control panel 7 to enhance workability. In particular, since the weight of the control panel counter-weight 34 is set to be greater than the weight of the control panel 7, it is possible to readily return the heavy control panel 7 from the maintenance position to the normal position.

Furthermore, since the maintenance position holding mechanism 27 is provided on the control panel 7, it is possible to readily hold the control panel 7 at the maintenance position during maintenance operations to thereby enhance workability.

In addition, the weight of the control panel counter-weight 34 may also be set to be smaller than the weight of the control panel 7. However, in this case, a holding mechanism for holding the control panel 7 in the normal position in the normal mode is required. Also, by providing holding mechanisms for the control panel 7 at the normal and maintenance positions respectively. The weight of the control panel counter-weight 34 may be set to be the same as the weight of the control panel 7.

Furthermore, a drive device such as a motor or the like may be installed in or connected to the pulley 32 so that the control panel 7 may be raised or lowered by the drive force of the drive device.

Fourth Embodiment

Figure 11:
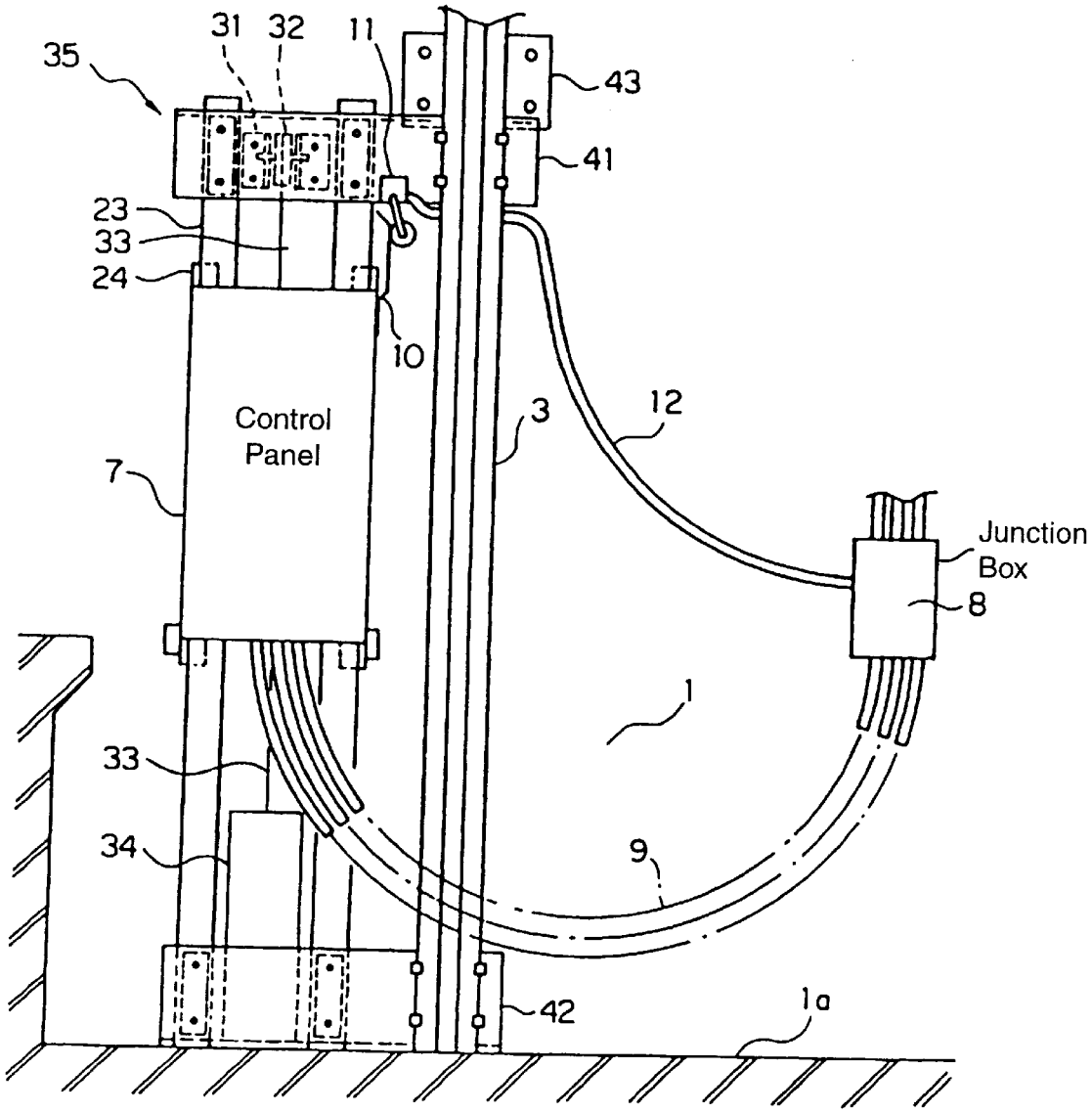
FIG. 11 is a front view showing an elevator controlling apparatus in accordance with a fourth embodiment of the present invention.
Figure 12:
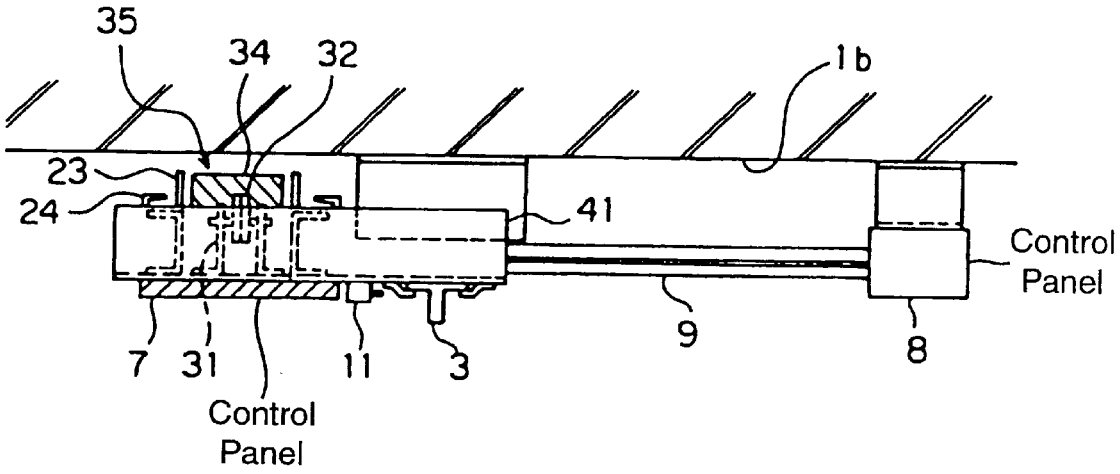
FIG. 12 is a plan view of the apparatus shown in FIG. 11.

Next, FIG. 11 is a front view showing an elevator controlling apparatus in accordance with a fourth embodiment of the present invention, and FIG. 12 is a plan view of the apparatus shown in FIG. 11. In this example, an upper end portion of a control panel rail 23 and a mounting member 31 are fixed to a rail bracket 41 on a rail side for fixing a guide rail 3 to a hoistway wall 1*b*. The rail bracket 41 on the rail side also serves as a support member. In addition, a lower end portion of the control panel rail 23 is fixed to a bottom portion rail bracket 42 for fixing the lower end portion of the guide rail 3 to a bottom portion 1*a* of a hoistway 1. The bottom portion rail bracket 42 also serves as a fixing member.

In the case where the guide rail 3 is installed within the hoistway 1, a wall side rail bracket 43 is first of all fixed; to the hoistway wall 1*b* through an anchor bolt. Next, the rail side rail bracket 41 and the bottom portion rail bracket 42 are tentatively retained at the guide rail 3 to thereby center guide rail 3. Thereafter, the rail side rail bracket 41 is welded to the wall side rail bracket 43 and at the same time, the bottom portion rail bracket 42 is fixed to the bottom portion 1*a* of the hoistway 1. Then, the rail side rail bracket 41 and the bottom portion rail bracket 42 are firmly fixed to the guide rail 3.

In such a controlling apparatus, it is possible to prevent the control panel 7 from being immersed in any water under normal conditions and to enhance the maintenance workability by lowering the control panel 7 down to the maintenance position in the maintenance mode. Also, since the rail brackets 41 and 42 are utilized as the support member and the fixing member, it is possible to reduce the number of components and facilitate installation work.

Figure 13:
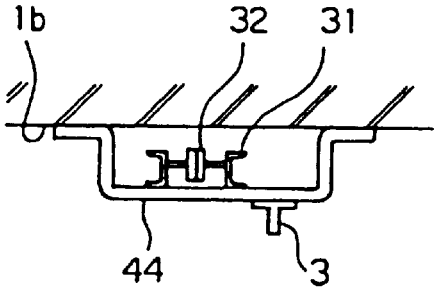
FIG. 13 is a plan view showing another example of a rail bracket shown in FIG. 12.

Further, in the fourth embodiment, the rail bracket 41 having an L-shaped cross-section is used as the support member. However, as shown in FIG. 13, a rail bracket 44, for example, having a hat-like cross-section may be utilized as the support member.

The rail bracket may also be utilized as both the suspension members 4 and 5 of the first embodiment and as the support member 21 and the fixing member 22 of the second embodiment.

What is claimed is:

1. An elevator controlling apparatus comprising:

a support mechanism located within a hoistway having a bottom Portion; and a control panel for controlling an operation of an elevator, said control panel being supported in an operation position at a first height above the bottom portion of the hoistway by said support mechanism, said control panel being movable up and down between the operation position and a maintenance position lower than the operation position.

2. The elevator control apparatus according to claim 1, further comprising a position detecting switch for detecting whether said control panel is located in the operation position, the operation mode of the elevator being switched to a maintenance mode and a lowermost descending position of a car being restricted when said control panel is moved from said operation position in response to detection by the position detection switch.

3. The elevator control apparatus according to claim 1, wherein said control panel has an openable door and a door detection switch for detecting whether the door is open or closed, the elevator being switched to the maintenance mode and a lowermost descending position of ascending and descending body being restricted when said door is open.

4. The elevator control apparatus according to claim 1, including a guide rail disposed within the hoistway for guiding raising and lowering of an ascending and descending body, said support mechanism being fixed to said guide rail.

5. The elevator controlling apparatus according to claim 4, wherein said support mechanism has a support member fixed to said guide rail and extending in a direction perpendicular to said guide rail, said support member also serving as a rail bracket for fixing said guide rail to a hoistway wall.

6. The elevator controlling apparatus according to claim 1, wherein said support mechanism has a first suspension member for suspending said control panel in the operation position and a second suspension member disposed below said first suspension member for suspending said control panel in the maintenance position, said control panel being selectively hooked to said first and second suspension members.

7. The elevator controlling apparatus according to claim 1, further comprising a control panel rail fixed within the hoistway for guiding raising and lowering of said control panel.

8. The elevator control apparatus according to claim 7, including a support member fixing said control panel rail to said control panel rail in a direction perpendicular to said control panel rail, and said support member also serving as a rail bracket for fixing said control panel rail to a hoistway wall.

9. The elevator controlling apparatus according to claim 7, further comprising a drive device for moving said control panel up and down along said control panel rail.

10. The elevator controlling apparatus according to claim 1, wherein said support mechanism has a lifting device for lifting said control panel against gravity to the operation position.

11. The elevator controlling apparatus according to claim 10, wherein a lifting force from said lifting device is greater than the gravitational force applied to said control panel, and including a maintenance position holding mechanism for holding said control panel in the maintenance position located in said control panel.

12. The elevator control apparatus according to claim 1, wherein said support mechanism has a rotatable pulley, a control panel suspension rope wound around said pulley for suspending said control panel at a first end of said control panel suspension rope, and a control panel counter-weight suspended at a second end of said control panel suspension rope.

13. The elevator controlling apparatus according to claim 1 further comprising a junction box fixed on a hoistway wall for connecting each instrument of the elevator and said control panel, to flexible cables suspended between said junction box and said control panel so that their intermediate portions are in a U-shaped form, electrically connecting said junction box and said control panel to each other.

* * * * *